United States Patent [19]

Duijvestijn

[11] 4,406,610

[45] Sep. 27, 1983

[54] PROCESS AND BURNER FOR THE PARTIAL COMBUSTION OF A LIQUID OR GASEOUS FUEL

[75] Inventor: Pius E. M. Duijvestijn, Amsterdam, Netherlands

[73] Assignee: Shell Oil Company, Houston, Tex.

[21] Appl. No.: 939,719

[22] Filed: Sep. 5, 1978

Related U.S. Application Data

[63] Continuation of Ser. No. 755,413, Dec. 29, 1976, abandoned.

[30] Foreign Application Priority Data

Dec. 30, 1975 [NL] Netherlands ..... 7515165

[51] Int. Cl.[3] ..... F23J 7/00

[52] U.S. Cl. ..... 431/4; 239/400; 239/403; 239/404; 431/8; 431/190

[58] Field of Search ..... 431/4, 8, 90, 190, 162, 431/210; 239/399, 400, 403, 404, 406

[56] References Cited

U.S. PATENT DOCUMENTS

| | | | |
|---|---|---|---|
| 828,804 | 8/1906 | Bird | 239/400 |
| 1,655,810 | 1/1928 | Cartwright | 239/400 |
| 2,095,242 | 10/1937 | Dick | 239/400 |
| 3,672,808 | 6/1972 | Meyazaki | 431/190 X |
| 3,804,579 | 4/1974 | Wilhelm | 431/190 X |

*Primary Examiner*—Edward G. Favors

[57] ABSTRACT

An improved process for the partial combustion of a liquid or gaseous fuel is disclosed, the process being characterized by the introduction of steam into the combustion reactor through the interior of a burner gun, the steam being introduced as a jet which rotates about its axis and diverges in the form of a cone. Apparatus for carrying out the process is also disclosed.

7 Claims, 2 Drawing Figures

PROCESS AND BURNER FOR THE PARTIAL COMBUSTION OF A LIQUID OR GASEOUS FUEL

This is a continuation of application Ser. No. 755,413, filed Dec. 29, 1976 abandoned.

The invention relates to a process for the partial combustion of a liquid or gaseous fuel in a reactor lined with refractory material, the fuel and an oxygen-containing gas needed for the combustion being introduced into the reactor via a burner.

The heat liberated in a process of this kind requires the application of a refractory lining in the reactor, which lining, however, often has to be renewed because of thermal degradation.

In the past it has been proposed to protect the interior of the reactor against an undue temperature rise by injecting water or steam or a cold, inert gas. However, by this injection frequently large local temperature differences occurred in the lining, which could also cause it to succumb prematurely. The reason of these local temperature differences was probably that insufficient mixing of the coolant with the reacting gases was effected, so that in some places there was excessive cooling whereas in other places there was no cooling at all.

It is an object of the present invention to remedy this situation and to provide a measure by which a uniform temperature reduction of the reactor lining is obtained.

The present invention thus relates to a process for the partial combustion of a liquid or gaseous fuel in a reactor lined with refractory material, the fuel and an oxygen-containing gas needed for the combustion being introduced into the reactor via a burner, in which a central jet of steam is also injected into the reactor via the burner, which jet diverges and rotates about its axis.

In this way efficient cooling is effected because the steam mixes right from the start with the fuel and the oxygen-containing gas.

A problem associated with the cooling of the interior of the reactor in the case of partial combustion in general, is the fact that the risk of soot formation often becomes much greater. The measure according to the invention has been found hardly to increase this risk. This can probably be explained from the fact that soot formation occurs in particular when there are too large local temperature differences in the reactor and that the measure according to the invention prevents such differences from occurring because of early and thorough mixing of the coolant and the fuel/oxygen mixture.

According to the invention a diverging jet of steam is injected into the reactor via the burner. Since this steam jet leaves the burner centrally and because the fuel and the oxygen-containing gas are also introduced into the reactor via the same burner, a diverging steam jet in particular will be mixed with the fuel and the oxygen-containing gas at the earliest possible moment and as thoroughly as possible.

The effect of the diverging steam jet is partly dependent on the angle of divergence. It has been found that in burners currently used for the partial combustion of fuels commonly so employed a divergence angle corresponding with a conical surface with a top angle of about 60° gives optimum results. It will be evident, however, that the top angle may range from as low as 30° to as high as 90°.

It has further been found that in particular a diverging and rotating steam jet can be produced by very simple means, because rotation can easily be utilized to cause divergence, in particular in cases where a hollow steam jet is ejected. It is then sufficient to cause the hollow rotating steam jet to leave the burner through an opening widening according to a substantially conical pattern. The hollow rotating jet will then diverge automatically.

The steam jet can be caused to rotate about its axis by passing the steam in the burner, for instance, to an ejection opening via ducts ending in it tangentially.

The invention is pre-eminently suitable for use in cases where a gaseous fuel is employed which itself leaves the burner in a hollow diverging jet. This will ensure efficient mixing with the oxygen-containing gas and a good combustion, without soot formation.

According to the invention it is preferred to use a burner with a straight burner gun, the oxygen-containing gas leaving the burner in the form of a jacket around the burner gun via an air register which gives the oxygen-containing gas not only an axial but also a tangential momentum. This measure also contributes to thorough mixing of the components to be introduced into the reactor, and hence to an optimum cooling effect of the steam introduced.

The process of the invention is very suitable for application in the production of reducing gases by partial combustion, in particular in the production of reducing gases to be used for the reduction of off-gases containing sulphur compounds.

An example of such an off-gas is the off-gas of a Claus unit, which contains some sulphur dioxide, hydrogen sulphide and/or carbonyl sulphide. From such off-gases the sulphur compounds can be removed by mixing them with a reducing gas, passing the gas mixture at a suitable temperature over a catalyst for the reduction of sulphur compounds other than hydrogen sulphide to hydrogen sulphide and by subsequently absorbing or adsorbing the hydrogen sulphide from the gas. The reducing gases needed for this off-gas purification preferably contain a high percentage of hydrogen and/or carbon monoxide.

The invention also relates to a burner for the partial combustion of a liquid or gaseous fuel which comprises means for the ejection of fuel and of oxygen-containing gas. The burner according to the invention comprises means for the ejection of a central steam jet, which means provide the steam jet not only with an axial but also with a tangential momentum. This burner is suitable for application in the process according to the invention because a central steam jet is obtained which rotates about its axis.

The burner according to the invention preferably comprises a straight double-barrelled burner gun in which the means for fuel ejection are located, the means for steam ejection being mounted centrally in the front end of the said burner gun. Such means for steam ejection may even be installed in some existing types of burner for partial combustion.

According to a preferred embodiment of the burner the means for steam ejection comprise a substantially tapering or funnel-shaped bore which diverges from the bottom to its top located at the burner gun front end and in which near the bottom tangential ducts have their outlets, these ducts being connected with a central hollow space in the burner gun. In this embodiment a hollow, central steam jet is obtained, which diverges and rotates about its axis.

The invention will hereinafter be elucidated by means of the drawings showing an embodiment of the burner according to the invention.

Figure 1:
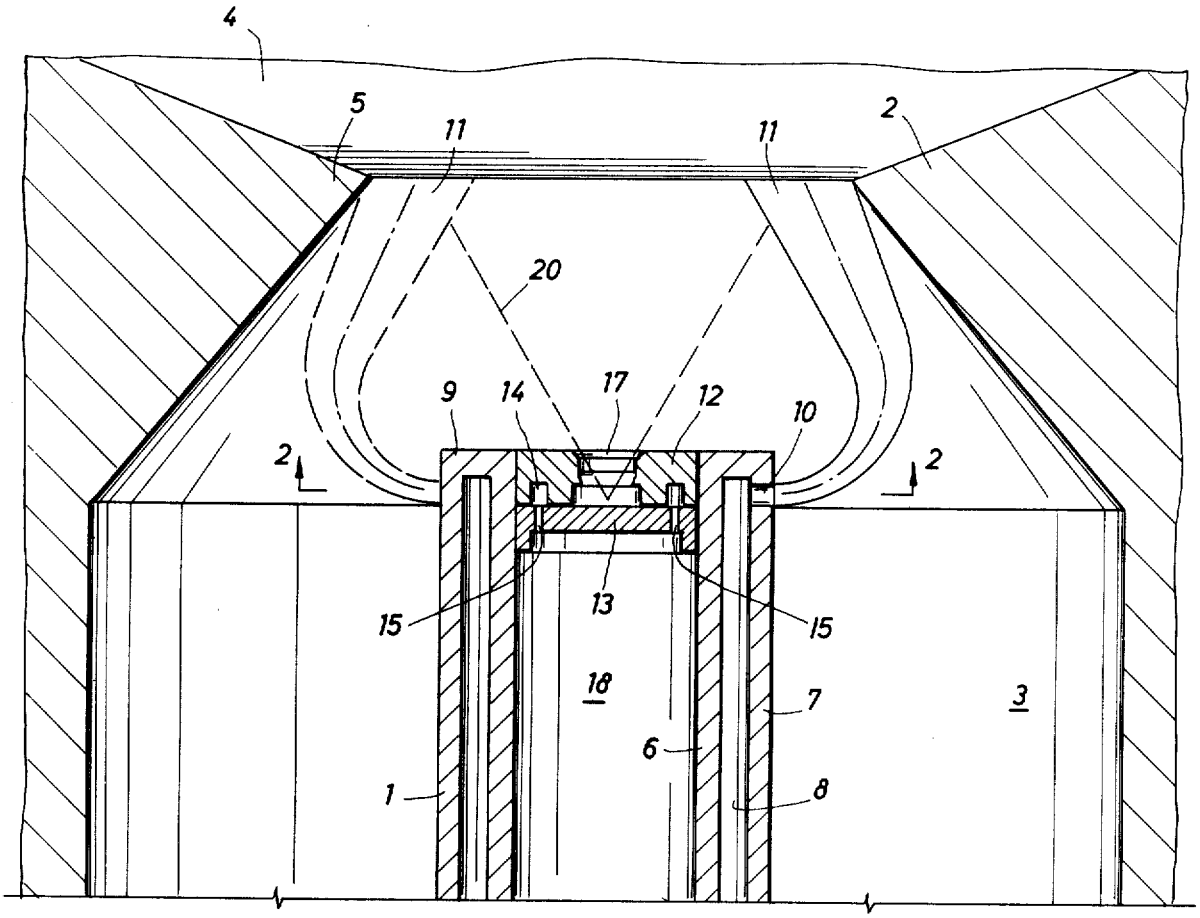
FIG. 1 is an axial cross-section of a part of a burner according to the invention.

In the drawings the front part of the gun 1 of a burner for the partial combustion of a gaseous fuel is illustrated. The gun 1 is located in a space 3 left open in the refractory lining 2 of a reactor. Between space 3 and reactor space 4 there is a constriction 5. Through the circular opening in this constriction fuel, combustion air, and steam which are injected by the burner, enter reactor space 4 from space 3.

The combustion air is introduced into space 3 via an air register (not shown), which is located at the far end of space 3 around burner gun 1. The combustion air flows in a hollow jet rotating about its axis forward along the burner gun 1 and enters reaction space 4 via constriction 5. The burner gun 1 comprises a double-barrelled tube, whose inner wall 6 and outer wall 7 form an annular slit 8 which is closed at its front end 9 and which gun, at some distance from this front end, has small holes 10 regularly spaced around the circumference of the outer wall 7. The gaseous fuel leaves the annular slit through the holes 10, which fuel is deviated under the influence of the rotating air stream, as indicated in the drawing near 11.

Figure 2:
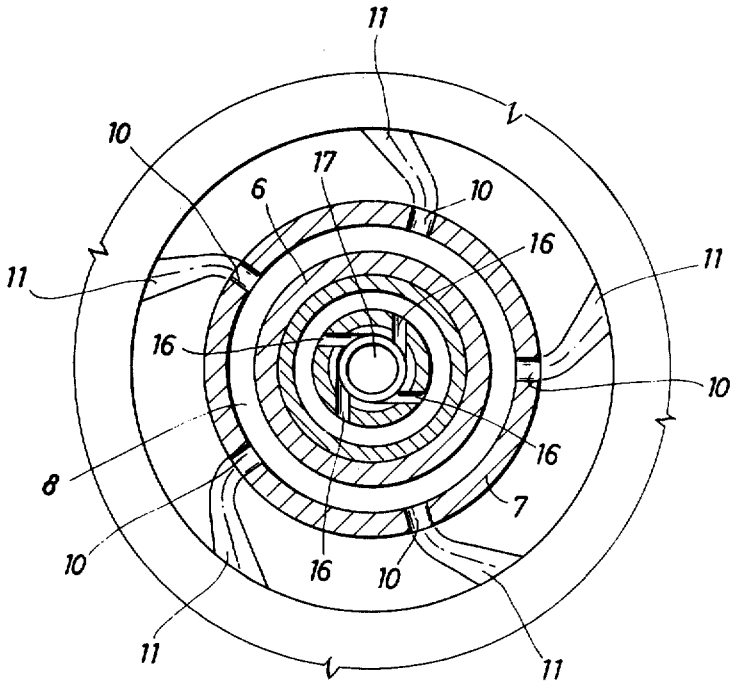
FIG. 2 is a radial cross-section according to plane II—II of the burner of FIG. 1.

The burner gun 1 further comprises a plug consisting of two separate parts 12 and 13, which is mounted in the front end of the double-barrelled tube. In the outer part 12, next to the interface between parts 13 and 12, there is an annular duct 14. This duct 14 is connected with the interior 18 of the burner gun via a number of holes 15 spaced regularly around the circumference of the duct. Further, channel 14 is connected with the central outlet opening 17 of the plug via four tangential slits 16 (see FIG. 2). Slits 16 end in opening 17, directly above the bottom thereof, which opening is closed at its bottom by the inner part 13 of the plug. The exit opening 17 widens outwards in a substantially conical shape.

The steam which is introduced at an elevated pressure via the interior 18 of the burner gun reaches duct 14 via holes 15 and flows from duct 14 via slits 16 into opening 17. The steam then leaves this outlet opening 17 as a hollow diverging jet 20 rotating about its axis. In the example of the embodiment illustrated here the conical surface along which the steam leaves the plug has a top angle of about 60°.

In the burner shown it has been found that directly beyond constriction 5 steam, air and gas in the reactor space 4 are mixed so thoroughly as to obtain an optimum cooling effect of the steam.

The invention will hereinafter be illustrated by an example.

EXAMPLE

With the burner assembly illustrated in the drawing a series of experiments was carried out. The reactor capacity was 0.16 $m^3$. The fuel was natural gas (86%v $CH_4$, balance $N_2$). The burner was provided with 13 fuel holes with a diameter of 4.5 mm and with 13 fuel holes with a diameter of 3.5 mm. In one of the experiments the burner was provided with a plug of the type illustrated in the drawing for the introduction of steam. In the other experiments liquid water was injected as a central jet via the burner in which a plug not in accordance with the invention has been mounted. In all the experiments the burner load was about 70%.

First natural gas was burned without the addition of steam or water at a stoichiometry (ratio of fuel to oxygen) of 57.2%; 61.4%; 66.8% and 75.2%, respectively. The flame temperatures, determined with the aid of a pyrometer, were 1310° C.; 1360° C.; 1385° C. and 1440° C., respectively. Next, natural gas was burned at a stoichiometry of about 80% with, respectively, a quantity of steam and water which quantities were equal to the quantity of natural gas (in kg/hour). The flame temperatures now were 1355° C. and 1400° C., respectively.

A comparison of these results shows that the flame temperature is influenced not only by the stoichiometry but also by the injection of water or steam and that the injection of steam in the manner according to the invention causes a relatively large temperature drop.

I claim:

1. In a process for the partial combustion of a liquid or gaseous fuel in a reactor lined with refractory material, wherein said fuel is introduced into the reactor via a burner gun of a burner as a hollow diverging jet, and an oxygen-containing gas is introduced into the reactor as a jacket around the burner gun, the improvement comprising introducing steam into the reactor through the burner gun as a central rotating and diverging steam jet interior to said fuel jet, the steam jet rotating about an axis coincident with the axis of the burner.

2. The process of claim 1 in which the steam jet diverges in the form of a cone with a top angle of from 30° to 90°.

3. The process of claim 2 in which the steam jet is hollow.

4. The process of claim 3 wherein a burner with a straight burner gun is used, and the oxygen-containing gas has an axial and a tangential momentum.

5. The process of claim 4 in which a gaseous fuel is used.

6. A burner for the partial combustion of a liquid or gaseous fuel comprising a burner gun having means for the ejection of a fuel, means surrounding said burner gun for providing an oxygen-containing gas as a jacket around the burner gun, and means for the ejection of a central steam jet mounted at the combustion end of the burner gun and interior to the means for the ejection of a fuel, said means for the ejection of a central steam jet comprising means for providing the steam jet with axial and tangential momentum.

7. The burner according to claim 6 wherein the means for the ejection of a central steam jet comprises a plug having a bore, the bore being substantially tapering or funnel-shaped and diverging from the bottom of the bore to the bore's top located at the burner gun combustion end, and in which said bore, near the bottom, tangential ducts have their outlets, the ducts being connected with a central hollow space in the burner gun.

* * * * *